US006101365A

United States Patent [19]

Nishikawa

[11] Patent Number: 6,101,365

[45] Date of Patent: Aug. 8, 2000

[54] IMAGE GENERATING APPARATUS WITH TENSION UNIT FOR ADJUSTING TENSION OF CONTINUOUS PAPER

[75] Inventor: Tomoyuki Nishikawa, Chiba, Japan

[73] Assignee: Asahi Kogaku Kogyo Kabushiki Kaisha, Tokyo, Japan

[21] Appl. No.: 09/433,206

[22] Filed: Nov. 4, 1999

[30] Foreign Application Priority Data

Nov. 6, 1998 [JP] Japan ..... 10-316050

[51] Int. Cl.[7] ..... G03G 15/00; G03G 15/20

[52] U.S. Cl. ..... 399/384; 399/322; 399/400

[58] Field of Search ..... 399/322, 324, 399/328, 330, 331, 332, 329, 384, 397, 400, 407

[56] References Cited

U.S. PATENT DOCUMENTS

| | | | |
|---|---|---|---|
| 5,142,339 | 8/1992 | Kasahara et al. | 399/322 |
| 5,159,394 | 10/1992 | Jinzai | 399/384 |
| 5,842,098 | 11/1998 | Ueno et al. | 399/322 |

*Primary Examiner*—William Royer
*Assistant Examiner*—Hoang Ngo
*Attorney, Agent, or Firm*—Greenblum & Bernstein, P.L.C.

[57] ABSTRACT

A laser printer capable of printing on a strip of fan fold paper includes a photosensitized drum for generating thereon a toner image to be transferred to the surface of the paper strip. The drum is associated with tractor assemblies operable in synchronism with the speed of the drum so as to determine travel speed of the paper strip passing by the drum. The laser printer further includes a fixing unit having a pair of fixing rollers for pressing the paper strip therebetween and a roller drive mechanism to drive the fixing rollers so as to determine travel speed of the paper strip passing through the fixing unit. A tension unit is disposed between the drum and the fixing unit for applying a tension to and thereby taking up slack of such portion of the paper strip that runs between the drum and the fixing unit. The tension unit includes a tensioning plate supported for pivotal motion and a helical tension spring for urging the tensioning plate. A sensing mechanism senses displacement of the tensioning plate. A control unit controls speed of the fixing rollers in an attempt to maintain displacement of the tensioning plate substantially at a desired level. The tension unit further includes an adjustment device for adjustment in the urging force to be applied by the spring to the tensioning plate.

16 Claims, 8 Drawing Sheets

IMAGE GENERATING APPARATUS WITH TENSION UNIT FOR ADJUSTING TENSION OF CONTINUOUS PAPER

The present disclosure relates to subject matter contained in Japanese Patent Application No. Hei-10-316050 filed on Nov. 6, 1998, which is expressly incorporated herein by reference in its entirety.

BACKGROUND OF THE INVENTION

1. Field of the Invention

The present invention relates to an electrostatic image generating apparatus, such as a laser printer, using a continuous strip of paper.

2. Description of the Related Art

There are used various electrostatic image generating apparatus, including electrostatic copiers, laser printers, laser facsimile machines and the like. A typical electrostatic image generating apparatus uses a photosensitized drum with a photosensitized surface made of photoconductive insulating material. A charging unit is used to place a uniform electrostatic charge over the photosensitized surface preparatory to imaging. Then, a desired light image is either projected by an optical system or drawn by a laser beam scanner on the photosensitized surface, to form an electrostatic latent image on the surface. Thereafter, the latent image is developed with a developing material, powdery material referred to in the art as toner, to form a toner image on that surface. The toner image is then transferred to a support surface, such as a surface of a sheet or strip of paper. The paper is then transported to a fixing unit, where the transferred toner image is fixed onto the surface of the paper.

Some laser printers which may be used, for example, with a computer system are designed to be capable of printing on a continuous strip of paper, such as a strip of fan fold paper having regularly spaced perforations along its longitudinal marginal edges. Where a continuous strip of paper is used, the portion of the paper strip running between the photosensitized drum and the fixing unit often has to be kept tensioned at an acceptable tension level. Thus, some of such laser printers include a tension unit for applying a predetermined level of tension to that portion of the paper strip.

It is often desired, however, to use with one laser printer various types of paper strips having acceptable tension ranges different from each other. In such case, the predetermined tension level provided by that laser printer may happen to be too high or too low for the paper strip that the operator wish to use. Acceptable tension level may vary depending on thickness of the paper strip, type of material of the paper strip, whether the paper strip is folded or not and whether the paper strip has transverse cutting lines of fine perforations or not. Too high a tension level may result in a breakage or tear of the paper strip, while too low a tension level may lead to frequent paper jams in the printer. In particular, where a strip of fan fold paper is used, too low a tension level is likely to cause a paper jam because such tension level often fails to make the strip of fan fold paper straight enough for smooth operation of the printer. This practically prevents use of a wide range of paper strips with one laser printer.

Accordingly, there has been a long desire for an electrostatic image generating apparatus using a continuous strip of paper, in which different types of continuous paper strips having different acceptable tension ranges may be conveniently used with that apparatus.

SUMMARY OF THE INVENTION

In view of the foregoing, it is an object of the present invention to provide an electrostatic image generating apparatus using a continuous strip of paper, in which the tension applied to the portion of the paper strip running between a photosensitized drum and a fixing unit may be adjusted in a simple and effective manner, so that different types of continuous paper strips having different acceptable tension ranges may be conveniently used with the electrostatic image generating apparatus.

In accordance with the present invention, there is provided an electrostatic image generating apparatus using a continuous strip of paper. The apparatus comprises a photosensitized drum for generating thereon a toner image to be transferred to the surface of the paper strip. The drum is associated with a paper feed mechanism operable in synchronism with speed of the drum so as to determine travel speed of the paper strip passing by the drum. The apparatus further comprises a fixing unit for fixing a toner image onto the toner image bearing surface of the paper strip. The fixing unit comprises a pair of fixing rollers for exerting a pressure to the paper strip passing therebetween and a roller drive mechanism for driving the fixing rollers so as to determine travel speed of the paper strip passing through the fixing unit. A tension unit is disposed between the drum and the fixing unit for applying a tension to and thereby taking up slack of such portion of the paper strip that runs between the drum and the fixing unit. The tension unit comprises (i) a tensioning element supported for displacement toward and away that surface of the portion of the paper strip which is opposite to the toner bearing surface, (ii) an urging mechanism for urging the tensioning element to press it against the portion of the paper strip so as to apply a tension thereto and (iii) a sensing mechanism for sensing displacement of the tensioning element as an indication of tension being imposed to the portion of the paper strip. A control unit is connected to the sensing mechanism and the roller drive mechanism for controlling speed of the fixing rollers in an attempt to maintain displacement of the tensioning element substantially at a predetermined desired level. Further, the tension unit comprises an adjustment device for adjustment in urging force to be applied by the urging mechanism to said tensioning element.

The tensioning element may preferably be supported for pivotal motion about a pivot axis. The pivot axis may preferably extend in transverse direction of the paper strip. The tensioning element may preferably be elongated in shape and extend parallel to the pivot axis.

The adjustment device may preferably provide for selection of level of urging force which is to be applied by the urging mechanism to the tensioning element, such that the level is selectable from two different predetermined levels. Alternatively, the adjustment device may preferably provide for selection of level of urging force which is to be applied by the urging mechanism to the tensioning element, such that the level is selectable from among three or more different predetermined levels. As a further option, the adjustment device may preferably provide for selection of level of urging force which is to be applied by the urging mechanism to the tensioning element, such that the level is selectable to any desired level within a predetermined range.

The urging mechanism may preferably comprise a torque generating mechanism for applying a torque to the tensioning element. In such case, the adjustment device provides for adjustment in torque to be applied by the torque generating mechanism to the tensioning element.

The torque generating mechanism may preferably comprise a spring member having first and second ends connected to the tensioning element and the adjustment device, respectively, and the adjustment device. may preferably comprise a position setting mechanism for setting position of the second end of the spring member.

The position setting mechanism may preferably comprise (i) a swing arm having a first end supported for pivotal motion and a second end connected to the second end of the spring member and (ii) an actuating mechanism for actuating the swing arm to provide change in angular position of the swing arm.

In one embodiment, the actuating mechanism comprises (i) a cam member acting on the swing arm and (ii) an electric motor having an output shaft operatively connected to the cam member.

In another embodiment, the actuating mechanism comprises (i) a cam member acting on the swing arm and (ii) a manually-driven handle operatively connected to the cam member.

In a still further embodiment, the position setting mechanism comprises an electromagnetic actuator having an output rod connected to the second end of the spring member.

The paper feed mechanism may preferably comprise a tractor assembly engaging and advancing a strip of fan fold paper having regularly spaced perforations along its longitudinal marginal edges. The fan fold paper may have transverse cutting lines of fine perforations provided at predetermined longitudinal intervals to establish substantially equal sized individual panels. Further, the fan folder paper may be alternately folded along the cutting lines with one panel upon another.

The electrostatic image generating apparatus may preferably be adapted to use a continuous strip selected from the group consisting of a strip of bond paper, a strip of cardboard, a strip of label carrier and a strip of transparency substrate.

BRIEF DESCRIPTION OF THE DRAWINGS

The above and other objects, features and advantages of the present invention will be apparent from the following detailed description of a preferred embodiment thereof, reference being made to the accompanying drawings, in which.

DETAILED DESCRIPTION OF A PREFERRED EMBODIMENT

Referring now to the accompanying drawings, a preferred embodiment of the present invention will be described in detail.

Figure 1:
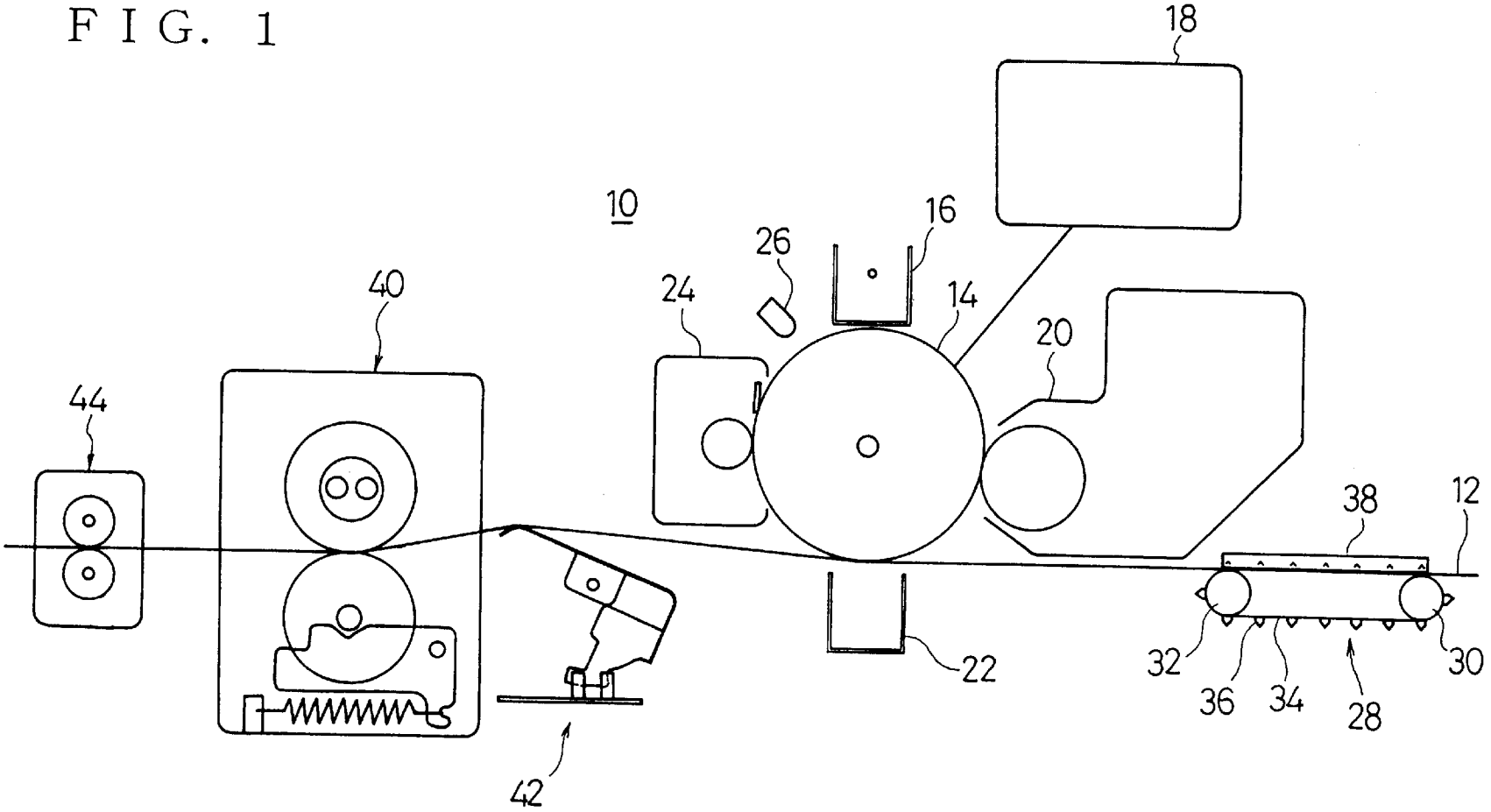
FIG. 1 is a highly simplified schematic showing critical elements of an electrostatic image generating apparatus, a laser printer, constructed and arranged in accordance with a preferred embodiment of the present invention and including a photosensitized drum, a fixing unit and a tension unit.

FIG. 1 is a highly simplified schematic showing an electrostatic image generating apparatus using a continuous strip of fan fold paper and including a tension unit forming a part of the present invention. The apparatus, generally designated by reference numeral 10, comprises a laser printer. FIG. 1 shows only elements of the laser printer 10 which form a part of and cooperate directly with the present invention. Elements not specifically shown or described are selectable from those known in the art.

The laser printer 10 is capable of using a continuous strip of paper as printing paper. The continuous strip of paper 12 shown loaded on the printer 10 is a strip of fan fold paper having regularly spaced perforations along its longitudinal marginal edges. The strip of fan fold paper 12 also has transverse cutting lines of fine perforations provided at predetermined longitudinal intervals to establish substantially equal sized individual panels, with which the strip of fan folder paper 12 is alternately folded along the cutting lines with one panel upon another.

The laser printer 10 has a paper strip transportation path defined therein, along which the paper strip 12 is transported. Also, various elements corresponding to the stages involved in the electrophotographic printing process are disposed along the paper strip transportation path. The laser printer 10 comprises a photosensitized drum 14 for generating thereon a toner image to be transferred to the surface of the paper strip 12. As is well known in the art, the photosensitized drum 14 has its outer peripheral surface coated with a suitable photoconductive material. Around the drum 14, there are disposed, in this order, a charging unit 16, an image drawing unit 18, a developer unit 20, an image transfer unit 22, a drum cleaning unit 24 and a discharging unit 26. This order corresponds to the sequence of the processes to be conducted to the photosensitized drum 14.

The charging unit 16 serves to place a uniform electrostatic charge over the photoconductive surface of the drum 14 preparatory to imaging. The image drawing unit 18 utilizes a laser beam scanner for projecting a focused laser beam onto the charged photoconductive surface so as to draw a desired image (which may be a text image or a picture image) on the surface. Any regions exposed to the laser beam will have the charge dissipated, so that an electrostatic latent image will be created on the drum surface. The developer unit 20 serves to develop the electrostatic latent image with a developing material, powdery material referred to in the art as toner, so as to form a toner image corresponding to the latent image. The developer unit 20 comprises a toner applicator for applying toner to the charged regions of the drum surface. The toner applicator may be any conventional means for providing the required function. For example, it may comprise any kind of magnetic brushes known in the art. The image transfer unit 22 serves to transfer the toner image from the drum surface to the surface of the paper strip 12. The drum cleaning unit 24 serves to remove residual toner particles remaining on the drum surface after image transfer. Finally, the discharging unit 26 illuminates the drum surface with light to effect substantially complete discharge of any residual electrostatic charge remaining on the drum surface prior to recycling.

The drum 14 is associated with a paper feed mechanism including a pair of known type of tractor assemblies (only one of them is shown in FIG. 1 and designated by reference numeral 28), one extending along each of the longitudinal edges of the strip of fan fold paper 12. The tractor assembly 28 comprises a drive sprocket 30, an idler sprocket 32, an internally-toothed endless belt 34 which is wound round on the sprockets 30 and 32 and carries a plurality of spaced drive protrusions 36 adapted to engage longitudinal edge perforations of the paper strip 12, and a paper guide plate 38 for guiding the longitudinal edge of the paper strip 12 between the belt 34 and the guide plate 38 to prevent skipping of the perforations of the paper strip 12 during operation. The tractor assembly 28 engages and provides positive advancement of the paper strip 12 and is driven by an associated drive mechanism (not shown) to operate in synchronism with speed of the drum 14, so that substantially no slip is allowed between the paper strip 12 and the drum surface. This means that the tractor assembly 28 determines travel speed of the paper strip 12 passing by the drum 14.

The laser printer 10 also includes a fixing unit 40, a tension unit 42 and a paper discharging unit 44. The fixing unit 40 serves to fix a toner image onto the toner image bearing surface of the paper strip 12 by heating and pressing the paper strip 12, as is well known in the art. A fixing unit of this type is also called a fuser unit. The tension unit 42 is disposed along the paper strip transportation path and between the photosensitized drum 14 and the fixing unit 40, serving to apply a tension to and thereby take up slack of such portion of the paper strip 12 that runs between the drum 14 and the fixing unit 40. The paper discharging unit 44 is disposed along the paper strip transportation path and downstream of the fixing unit 40. The paper discharging unit 44 serves to advance and guide the paper strip 12 exiting the fixing unit 40 so as to discharge it out of the printer 10 through a paper discharging slot (not shown) formed in the housing (not shown) of the printer 10. The fixing unit 40, the tension unit 42 and the paper discharging unit 44 will be described in more detail below.

Figure 2:
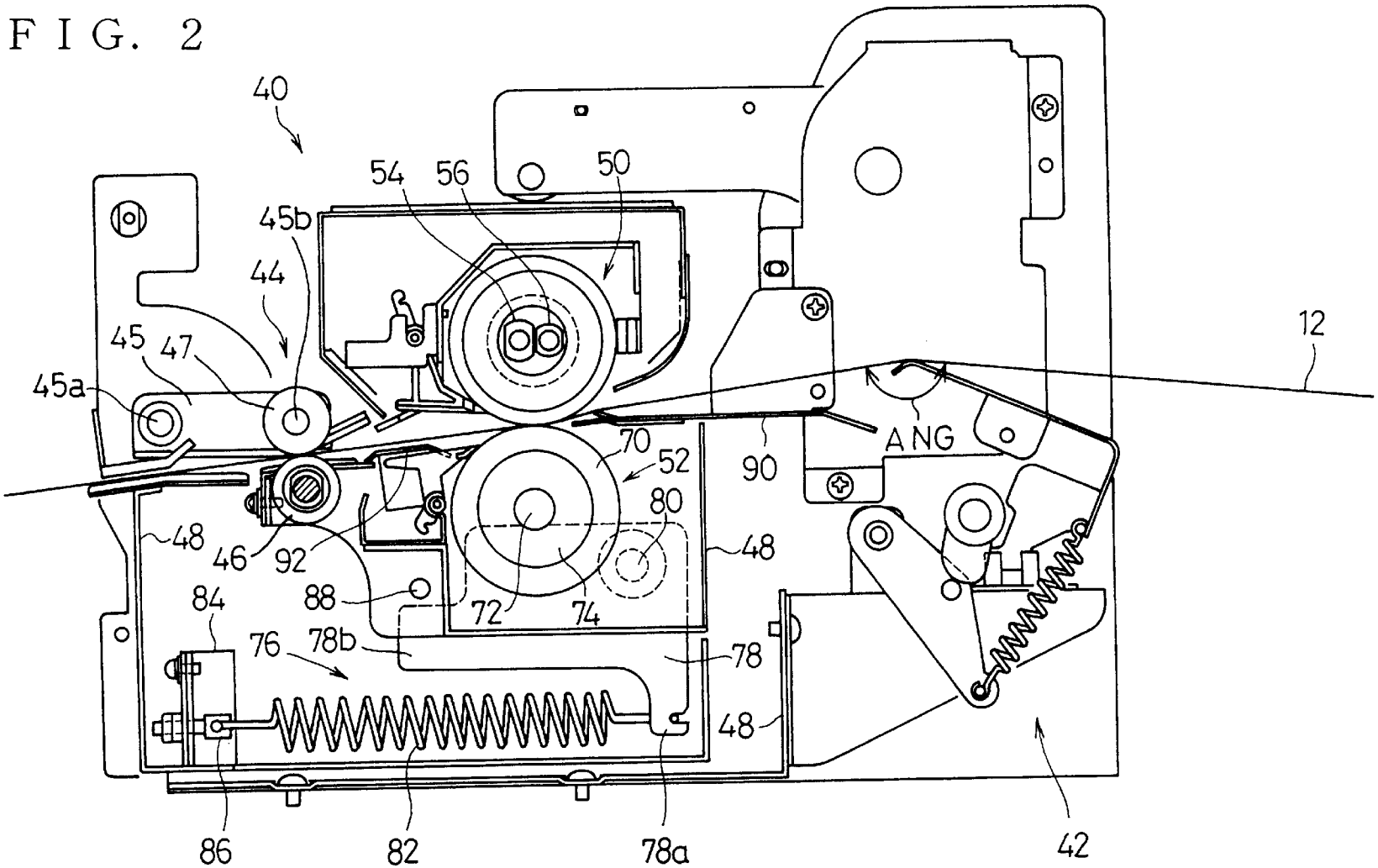
FIG. 2 is a side elevation of an assembly used in the laser printer, including the fixing unit and the tension unit of FIG. 1.

FIG. 2 is a side elevation of an assembly used in the laser printer 10, in which the fixing unit 40, the tension unit 42 and the paper discharging unit 44 are disposed. The assembly includes an assembly frame 48, on which various elements of the fixing unit 40, the tension unit 42, the paper discharging unit 44 and other components are mounted.

The paper discharging unit 44 includes a swing arm 45, a drive roller 46 and guide wheels 47. The drive roller 46 is mounted on the frame 48 for rotation by means of bearings (not shown), with its axis extending horizontally in the transverse direction of the paper strip 12. The drive roller 46 is operatively connected to a drive unit (not shown) including an electric motor for driving the drive roller 46 for rotation. The swing arm 45 is pivotally connected to and supported by the frame 48 through a pivot pin 45*a* such that the distal of the swing arm 45 may swing in the vertical direction. The swing arm 45 has a shaft 45*b* connected to the distal, with its axis extending parallel to the axis of the drive roller 46. The guide wheels 47 are mounted on the shaft 45*b* for free rotation relative to the shaft 45*b*. The guide wheels 47 are held on the drive roller 46 by gravity and an urging force of a spring (not shown), with the paper strip 12 being inserted between the drive roller 46 and the guide wheels 47. The friction acting from the drive roller 46 to the under surface of the paper strip 12 is relatively small, so that the paper strip 12 may easily slip against the drive roller 46. Thus, the paper discharging unit 44 merely guides the paper strip 12 exiting the printer 10 and does not absolutely determine travel speed of the paper strip 12 passing through the paper discharging unit 44.

The fixing unit 40 includes a pair of fixing rollers 50 and 52, as well as a roller drive mechanism 62 (FIG. 4) for driving the fixing rollers 50 and 52. The fixing rollers 50 and 52 are disposed one above the other and supported by the frame 48. The upper roller 50 is an internally-heated fuser roller for heating and melting a fusible toner image being carried on the surface of the paper strip 12, while the lower roller 52 is a spring-loaded pressure roller normally pressed against the fuser roller 50.

More specifically, the fuser roller 50 includes a rigid, hollow, cylindrical core that is heat conductive. Two slender halogen lamps 54 and 56 serving as heaters are housed in the core so as to extend side by side and along the longitudinal axis of the core. The fuser roller 50 further includes a compliant outer layer covering the core, which is made of a suitable elastomeric material. The fuser roller 50 is supported at its opposite ends by bearings which are fixedly mounted on the frame 48, so that the fuser roller 50 is immovable relative to the frame 48 except for rotation about its axis. The fuser roller 52 has a gear 60 (FIG. 5) fixedly attached thereto at one end thereof. The gear 60 is operatively connected to an electric motor 64 (FIG. 4) of the roller drive mechanism 62 through a gear train.

The pressure roller 52 includes a rigid, hollow, cylindrical shell 70 and a shaft 72 extending coaxial with and through the shell 70. The shell 70 is mounted on the shaft 72 for free rotation through a pair of bearings 74, which are disposed at opposite ends of the shell 70 and housed within the shell 70. The pressure roller 52 is provided with a loading mechanism for pressing the pressure roller 52 against the fuser roller 50.

The loading mechanism comprises a pair of loading units (only one of them is shown in FIG. 2 and designated by reference numeral 76), one engaging and supporting each end of the shaft 72 of the pressure roller 52. The loading units are mirror images to each other, so that only one of them is described here. The loading unit 76 shown includes a swing plate 78 pivotally connected to the frame 48 through a pivot pin 80. As shown in FIG. 2, the swing plate 78 is generally rectangular in shape, with a bottom arm portion 78*a* and a side arm portion 78*b* protruding downward and sideward, respectively, out of the rectangular contour of the plate 78. The swing plate 78 also has an upper horizontal edge, in which a V-shaped cutout is formed for receiving the end of the shaft 72 of the pressure roller 52. The loading unit 76 further includes a helical spring 82 for exerting a torque to the swing arm 78 in an attempt to rotate the swing arm 78 so as to raise the pressure roller 52 to press it against the fuser roller 50. The spring 82 has a first end connected to the bottom arm portion 78*a* of the swing plate 78 and a second end to the frame 48 through a bracket 84 and an adjustment screw 86. The bracket 84 is fixedly secured to the frame 48 and the adjustment screw 86 is attached to the bracket 84. The spring 82 is normally tensioned to pull sideward the bottom arm portion 78*a* of the swing plate 78, so as to apply a torque to the swing plate 78. The torque is adjustable by means of the adjustment screw 86, and the torque adjustment results in an adjustment in the pressure exerted from the fixing rollers 50 and 52 to the paper strip 12 traveling between them. A stop pin 88 is secured to the frame 48. When the pressure roller 52 is removed away for maintenance or other reasons, the side arm portion 78*a* of the swing plate 78 abuts against the stop pin 88 to limit rotation of the swing plate 78.

The fixing unit 40 further includes an entrance guide plate 90 and an exit guide plate 92. These guide plates 90 and 92 are fixedly secured to the frame 48 so as to extend generally horizontally.

In operation, the fuser roller 50 is heated by the halogen lamps 54 and 56 while pressure roller 52 is pressed against the fuser roller 50 by the loading mechanism comprising a pair of loading units 76. The fuser roller 50 is driven for rotation by the roller drive mechanism 62 to cause the paper strip 12 bearing a toner image to travel between the rollers 50 and 52, during which the toner image is fused in and thereby fixed onto the surface of the paper strip 12. The pressure exerted to the paper strip 12 by the rollers 50 and 52 is relatively high, so that substantially no slip is allowed between the paper strip 12 and the rollers 50 and 52. This means that the fixing unit 40 determines travel speed of the paper strip 12 passing through the fixing unit 40.

Figure 3:
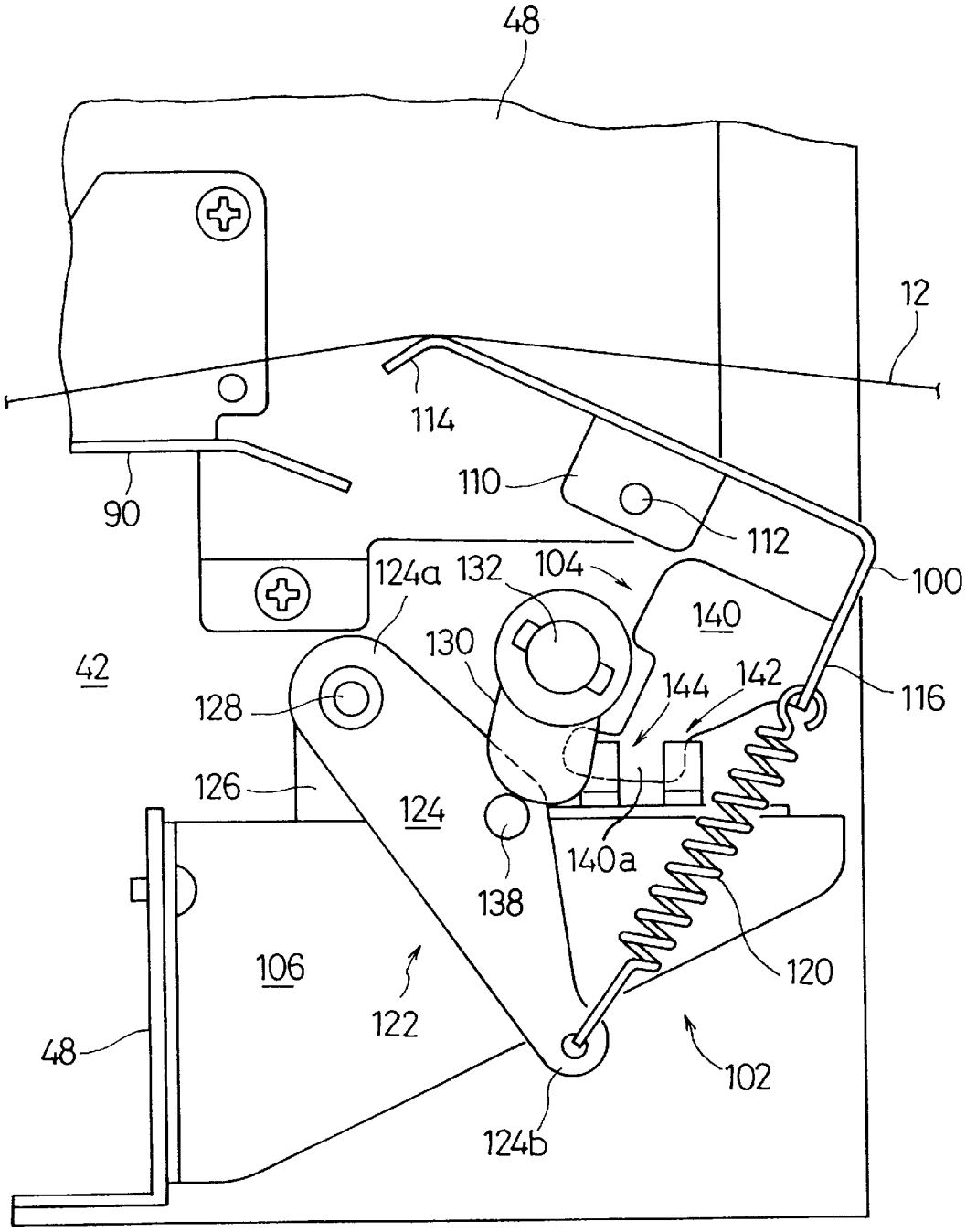
FIG. 3 is an enlarged side elevation of the tension unit of FIG. 2.
Figure 4:
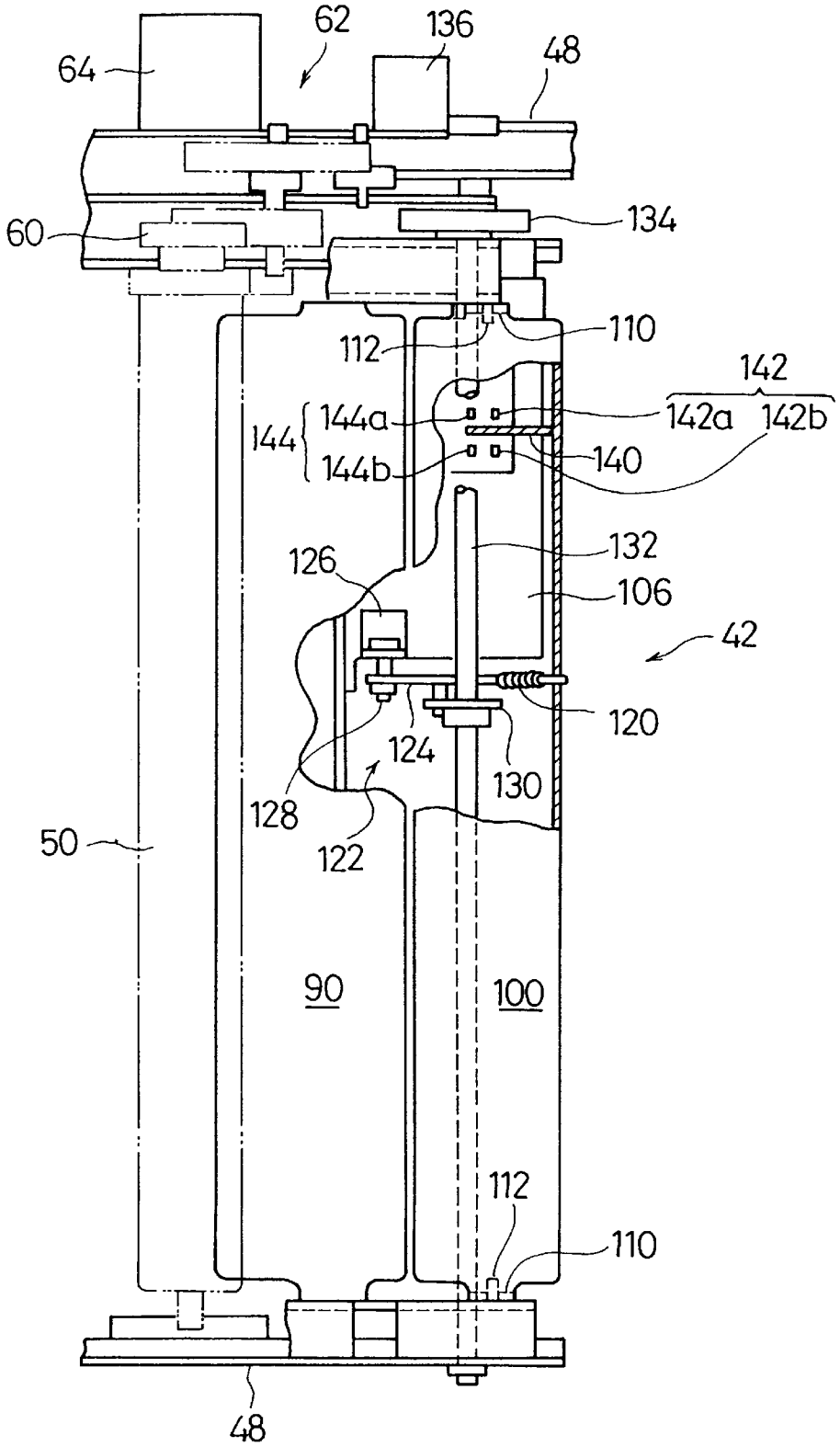
FIG. 4 is a plan view of the tension unit of FIG. 2.

FIGS. 3 and 4 are an enlarged side elevation and a plan view of the tension unit 42 shown in FIGS. 1 and 2. Briefly, the tension unit 42 includes a paper strip tensioning plate 100 supported for displacement toward and away the surface of such portion of the paper strip 12 that runs between the photosensitized drum 14 and the fixing unit 40. Here, the surface of the paper strip 12 that is accessible to the paper strip tensioning plate 100 is the surface opposite to the toner image bearing surface, and is referred to hereinafter as the "backside" of the paper strip 12. Also, for convenience, the portion of the paper strip 12 that runs between the photosensitized drum 14 and the fixing unit 40 is referred to hereinafter as the "target portion" of the paper strip 12. The tension unit 42 further includes an urging mechanism 102 for urging the tensioning plate 100 to press it against the backside of the target portion of the paper strip 12 so as to apply a tension to the target portion of the paper strip 12. The tension unit 42 further includes a sensing mechanism 104 for sensing displacement of the tensioning plate 100 as an indication of tension being imposed to the target portion of the paper strip 12.

More particularly, a support bed 106 constituting a part of the frame 48 is provided for the tension unit 42. Some elements of the tension unit 42 described below are mounted on the support bed 106. The tensioning plate 100 is elongated in shape and made from a thin metal sheet. The tensioning plate 100 has a substantially flat, elongated, rectangular, main wall portion to extend substantially horizontally under the target portion of the paper strip 12. The tensioning plate 100 also has a pair of tabs 110 dependent from the main wall portion, one formed at each of opposite longitudinal ends of the elongated main wall portion. The tensioning plate 100 is connected to and supported by side walls of the frame 48, through a pair of pivot pins 112 fixed to the side walls and fitted in corresponding holes formed in the tabs 110, so that the tensioning plate 100 is capable of pivotal motion about a pivot axis which is defined by the pivot pins 112. The pivot axis extends horizontally in the transverse direction of the paper strip 12. The elongated tensioning plate 100 extends parallel to the pivot axis and thus horizontally in the transverse direction of the paper strip 12.

The tensioning plate 100 has an L-shaped cross section defining first and second longitudinal edges 114 and 116, which are parallel to each other and extend horizontally in the transverse direction of the paper strip 12. With the axes of the photosensitized drum 14 and the fixing rollers 50 and 52 extending horizontally, the surfaces of the target portion of the paper strip 12 also extend substantially horizontally. The first edge 114 of the tensioning plate 100 is capable of displacement toward and away the backside of the target portion of the paper strip 12 as the tensioning plate 100 makes pivotal motions, and the first edge 114 is adapted to be in contact with the backside of the paper strip 12. In order not to damage the paper strip 12, the first edge 114 is shaped to have a moderate curve, as shown in FIG. 3, and is finished to have a smooth outer surface at which it is in contact with the backside of paper strip 12.

The urging mechanism 102 comprises a helical tension spring 120 so connected as to pull down the second edge 116 of the tensioning plate 100. With the tensioning plate 100 being pivotally supported by the frame 48 through the pivot pins 112, the pulling force of the spring 120 serves to apply a torque to the tensioning plate 100. Thus, with the disclosed embodiment, the urging mechanism 102 comprises a torque generating mechanism for the tensioning plate 100.

In accordance with one of the important features of the present invention, the tension unit 42 further comprises an adjustment device 122 for adjustment in the urging force to be applied by the urging mechanism 102 to the tensioning plate 100. In particular, since the urging mechanism 102 in this embodiment comprises a torque generating mechanism, the adjustment in such urging force directly means an adjustment in the torque to be applied by the mechanism 102 to the tensioning plate 100.

The adjustment device 122 comprises a swing arm 124, which has a first end pivotally connected to a bracket 126 through a pivot pin 128. The bracket 126 is fixedly mounted to the support bed 106 and thus to the frame 48. Therefore, the swing arm 124 has the first end 124*a* supported for pivotal motion of the swing arm 124. There is provided an actuating mechanism for actuating the swing arm 124 to provide change in angular position of the swing arm 124. The actuating mechanism comprises a cam member 130 fixedly mounted on a cam shaft 132, which extends parallel to the tensioning plate 100 and is supported at opposite ends by the side walls of the frame 48 for rotation. The cam shaft 132 has a gear 134 fixedly mounted on one end of thereof. The actuating mechanism further comprises an electric motor 136 having an output shaft (not shown) operatively connected through a gear train (not shown) to the gear 134 on the cam shaft 132, and thus to the cam member 130 on the cam shaft 132. The swing arm 124 has a pin 138 fixedly mounted thereon and disposed near the midpoint along its length. The spring 120 has a first end connected to the second edge 116 of the tensioning plate 100 and a second end to the second end 124*b* of the swing arm 124. Thus, the swing arm 124 is normally pulled by the spring 120 toward the cam member 130, so that the pin 138 on the swing arm 124 is always kept pressed against the peripheral edge of the cam member 130, as shown in FIG. 3.

With this arrangement, when rotated by the electric motor 136, the cam member 130 causes the second end 124*b* of the swing arm 124 to move toward/away the second edge 116 of the tensioning plate 100. Therefore, the swing arm 124 and the actuating mechanism (comprising the cam member 130 and the electric motor 136) for actuating the swing arm 124 together constitute a position setting mechanism for setting position of the second end of the spring 120.

The movement of the second end 124*b* of the swing arm 124 (and thus the movement of the second end of the spring 120) caused by rotation of the cam member 130 provides the corresponding change in the urging force (and thus the torque) applied by the spring 120 to the tensioning plate 100. The change in the urging force depends on (i) the contour of the cam member 130 and (ii) the angle of rotation of the cam member 130. Depending on selection of these two factors, various configurations of the adjustment device 122 may be realized. For example, in the case of an adjustment device where the swing arm 124 may be located at either of two, and only two predetermined angular positions, then the adjustment device provides for selection of the level of the urging force which is to be applied by the spring 120 to the tensioning plate 100, such that the level is selectable from two different predetermined levels. Alternatively, in the case of an adjustment device where the swing arm 124 may be located at any of three or more predetermined angular positions, then the adjustment device provides for selection of the level of the urging force such that the level is selectable from among three or more different predetermined levels. Moreover, in the case of an adjustment device where the swing arm 124 may be located at any angular position within a predetermined position range, then the adjustment device provides for selection of the level of the urging force such that the level is selectable to any desired level within a predetermined level range.

Further, any change in the urging force (and thus in the torque) applied by the spring 120 to the tensioning plate 100 will result in the corresponding change in the urging force that is applied by the tensioning plate 100 to the paper strip 12. As described, the final purpose of the tension unit 42 is to apply a tension to and thereby to take up slack of the target portion of the paper strip 12. The actual tension to be imposed to the target portion of the paper strip 12 is determined by two factors. One is the urging force to be applied by the tensioning plate 100 to the paper strip 12 and the other is the angle ANG (FIG. 2) formed between the portion of the paper strip 12 running from the drum 14 to the tensioning plate 100 and that from the tensioning plate 100 to the fixing rollers 50 and 52. Apparently, for a given urging force, the tension increases as the angle ANG becomes larger to approach 180-degrees. The sensing mechanism 104 mentioned above is used to control the angle ANG, as shown in the following description.

The sensing mechanism 104 comprises a shade plate 140 fixedly connected to the tensioning plate 100 and two (first and second) photo sensors 142 and 144 associated to the shade plate 140. Each photo sensor has an arrangement well known in the field of sensors, in which a light-emitting-diode (LED)142*a*/144*a* and a photo transistor 142*b*/144*b* are disposed side by side with their light emitting/receiving surfaces facing to each other and with a small gap left between them, so that a light beam from the LED 142*a*/144*a* may be received by the photosensitive surface of the associated photo transistor 142*b*/144*b*. The shade plate 140 is a flat plate extending in a plane perpendicular to the pivot axis of the tensioning plate 100 and lying in the gap between the LED 142*a*/144*a* and the photo transistor 142*b*/144*b* of each photo sensor 142/144. The shade plate 140 has a sectorial portion 140*a* at its tip end. The sectorial portion 140*a* is centered to the pivot axis of the tensioning plate 100, which axis is defined by the pivot pins 112. When the tensioning plate 100 is at a first angular position, the sectorial portion 140*a* of the shade plate 140 partially blocks the light beam of the first photo sensor 142. When the tensioning plate 100 is at a second angular position, the sectorial portion 140*a* of the shade plate 140 partially blocks the light beam of the second photo sensor 142. If the tensioning plate 100 is at an angular position well between the first and second angular positions, the light beams of the first and second photo sensors 142 and 144 are both blocked. When the tensioning plate 100 rotates from there in the clockwise direction as seen in FIG. 3 to exceed the first angular position, then the light beam of the first photo sensor 142 is no longer blocked while that of the second photo sensor 144 remains blocked. When the tensioning plate 100 rotates in the reverse direction to exceed the second angular position, then the light beam of the second photo sensor 144 is no longer blocked while that of the first photo sensor 142 remains blocked. The first and second sensors 142 and 144 produce detection signals reflecting whether the corresponding light beams are blocked or not. The detection signals are provided to a control unit 150 (FIG. 5) and used to control the speed of the fixing rollers 50 and 52 of the fixing unit 40. Since the speed of the photosensitized drum 14 is maintained substantially at a fixed speed during the operation, any increase in the speed of the fixing rollers 50 and 52 causes the angel ANG formed between the portion of the paper strip 12 running from the drum 14 to the tensioning plate 100 and that from the tensioning plate 100 to the fixing rollers 50 and 52 to become larger to approach 180-degrees, while any decrease in the speed of the fixing rollers 50 and 52 causes the reverse effect to the angle ANG.

The angle ANG could be possibly adjusted by changing the speed of the photosensitized drum 14 and the associated tractors 28; however, the speed of the photosensitized drum 14 has to be synchronized to the operation of the image drawing unit 18, so that changing the speed of the photosensitized drum 14 is impractical. For this reason, it is preferable to change the speed of the fixing rollers 50 and 52 in order to adjust the angle ANG.

As described above, the sensing mechanism 104 detects the angular position of the tensioning plate 100. Apparently, the angular position of the tensioning plate 100 determines the displacement of the tensioning plate 100 (more particularly, the displacement of the first edge 114 of the tensioning plate 100) toward/away the surface of the paper strip 12. Thus, the sensing mechanism 104 actually serves to sense the displacement of the tensioning plate 100 toward/away the surface of the paper strip 12. Further, the displacement of the tensioning plate 100 toward/away the surface of the paper strip 12 determines the angle ANG formed between the portion of the paper strip 12 running from the drum 14 to the tensioning plate 100 and that from the tensioning plate 100 to the fixing rollers 50 and 52. This means that such displacement of the tensioning plate 100 will be an indication of the tension being imposed to the target portion of the paper strip 12 as long as the urging force applied by the spring 120 to the tensioning plate 100 is maintained at a substantially constant level. Thus, the sensing mechanism 104 senses the displacement of the tensioning plate 100 as an indication of the tension being imposed to the target portion of the paper strip 12, as previously mentioned.

The control unit 150 (FIG. 5) is connected to the sensing mechanism (more particularly, to the first and second sensors 142 and 144) as well as to the roller drive mechanism 62 for the fixing rollers 50 and 52. The control unit 150 responds to the detection signals from the sensing mechanism by controlling the speed of the fixing rollers 50 and 52 in an attempt to maintain the displacement of the tensioning plate 110 substantially at a predetermined desired level, by using a known feedback control technique. As long as this control is effective, the tension being imposed to the target portion of the paper strip 12 is determined solely by the urging force applied by the tensioning plate 100 to the paper strip 12, and thus solely by the urging force applied by the spring 120 to the tensioning plate 100.

Accordingly, the tension to be imposed to such portion of the paper strip 12 that runs between the photosensitized drum 14 and the fixing unit 40 may be adjusted by changing the angular position of the cam member 130. Further, the angular position of the cam member 130 can be changed by the operation of the electric motor 136 forming a part of the adjustment device 122. While the electric motor 136 may be controlled with any of various control configurations, one example of such control configuration is described below with reference to FIG. 5.

Figure 5:
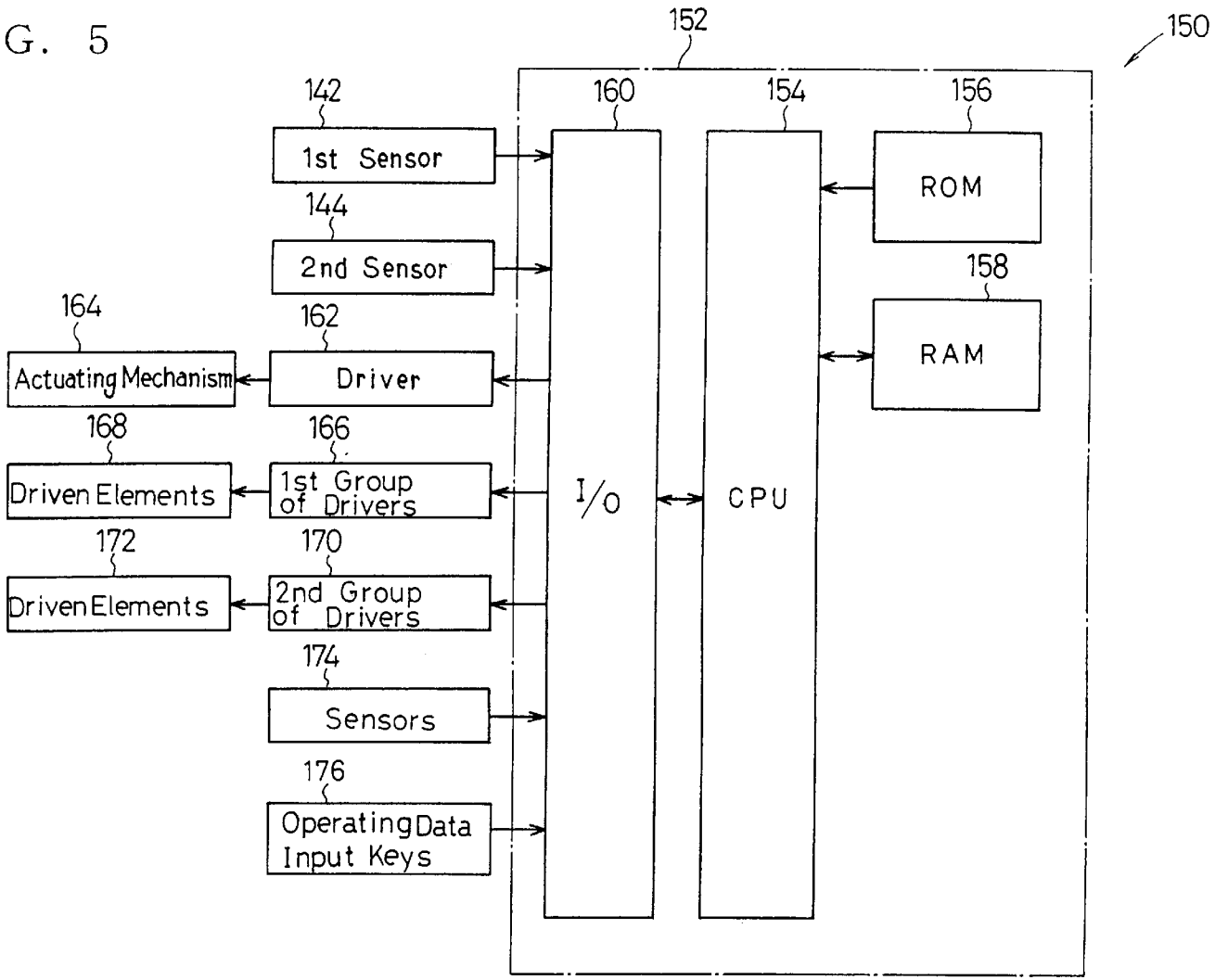
FIG. 5 is a block diagram of a control unit cooperating with the tension unit of FIG. 2.

FIG. 5 is a highly simplified block diagram showing the control unit 150. As shown, the control unit 150 comprises a microcomputer-based logic and control 152 connected to several peripheral components. The logic and control 152 comprises a central processing unit (CPU) 154; a read-only-memory (ROM) 156 storing program codes and other data required for conducting control of any and all functions of the laser printer 10; a random-access-memory (RAM) 158 providing a working storage area for the CPU 154 and a temporary data storage area; and an input/output interface (I/O) 160 providing data links between the CPU 154 and the peripheral components. The control unit 150 further comprises a parallel port and associated circuitry for communicating with a host system connected with the laser printer 10. Such port and circuitry are conventional ones and thus not shown in FIG. 5.

The I/O 160 is connected to the first and second sensors 142 and 144 to receive detection signals from them. The I/O 160 is also connected to a driver 162 for outputting control signals to the actuating mechanism. As described above, the actuating mechanism comprises the cam member 130, the cam shaft 132, the electric motor 136 and other associated elements; however, in FIG. 5 the actuating mechanism is schematically indicated by a block 164.

The I/O 160 is also connected to a first group of drivers 166 for driven elements which are involved in the transportation of the paper strip 12. Such driven elements are schematically indicated by a block 168 in FIG. 5 and include the electric motors used for transportation of the paper strip 12, such as the motor for the tractors 28, the motor for the photosensitized drum 14, the motor for the fuser roller 50 and the motor for the drive roller 46 of the paper discharging unit 44. Such driven elements further include indicator lamps relating to the paper strip transportation, such as a paper-absence-indicator and a paper-jam-indicator. In particular, the first group of drivers 166 include a driver serving to control the speed of paper strip 12 passing by the photosensitized drum 14 and another driver serving to control the speed of the paper strip 12 passing through the fixing unit 40. These speed control operations are effected independently as described above, so that the displacement of the tensioning plate 100 toward/away the target portion of the paper strip 12 can be adjusted through such speed control operations.

The I/O 160 is also connected to a second group of drivers 170 for driven elements which are more directly involved in the printing operations. Such driven elements are schematically indicated by a block 172 in FIG. 5 and include the image drawing unit 18 (FIG. 1). In particular, printing data is transmitted through a driver among the second group of drivers 170 to the image drawing unit 18.

The I/O 160 is also connected to sensors schematically indicated by a block 174, including a paper-absence detection sensor, a paper-jam detection sensor, a toner-depletion detection sensor and a cabinet-door-opening detection sensor, all of which are known in the art. The I/O 160 is also connected to operating data input keys schematically indicated by a block 176. The keys 176 are provided on a control panel (not shown) of the laser printer 10 and used by the operator in order to set and/or control various functions of the laser printer 10.

The logic and control 152 and the user-operated keys 176 may be configured in various configurations, on which the manner of operation for selecting the tension level of the paper strip 12 partially depends. One possible, and highly simple manner of operation for selecting the tension level is to allow the operator to select one of the predetermined tension levels. In this case, the operator himself/herself makes choice of a suitable tension level from among the predetermined tension levels, in view of the related factors of the paper strip to be used. Such factors include, for example, the thickness of the paper strip; the type of material of the paper strip; whether the paper strip is folded or not; and whether the paper strip has transverse cutting lines of fine perforations or not. Generally, higher tension levels are suitable for thicker paper strips, stiffer paper strips, folded paper strips and/or paper strips having transverse cutting lines of fine perforations. In particular, folded paper strips, such as a strip of fan fold paper, require higher tension levels because too low a tension level is likely to fail to make the folded paper strip straight enough for smooth operation of the printer, resulting in a possible paper jam.

Alternatively, it is also useful to allow the user to enter in the control unit 150 information about characteristics of the paper strip to be used, and the control unit 150 uses the entered information to select an acceptable tension level and controls the adjustment device 122 depending on the tension level thus selected. The information may contain the thickness of the paper strip, the type of material of the paper strip, whether it is folded or not and/or whether is has transverse cutting lines of fine perforations or not.

As apparent to those skilled in the art, the term "paper strip" used here means a strip of any printable materials, and is not limited to a strip of materials included in the scope of classical definitions of papers. For example, a strip of transparency substrate is a "paper strip" for the present invention. In fact, by utilizing the present invention, an electrostatic image generating apparatus can use various types of paper strips including a strip of bond paper, a strip of cardboard, a strip of label carrier and a strip of transparency substrate.

Figure 6:
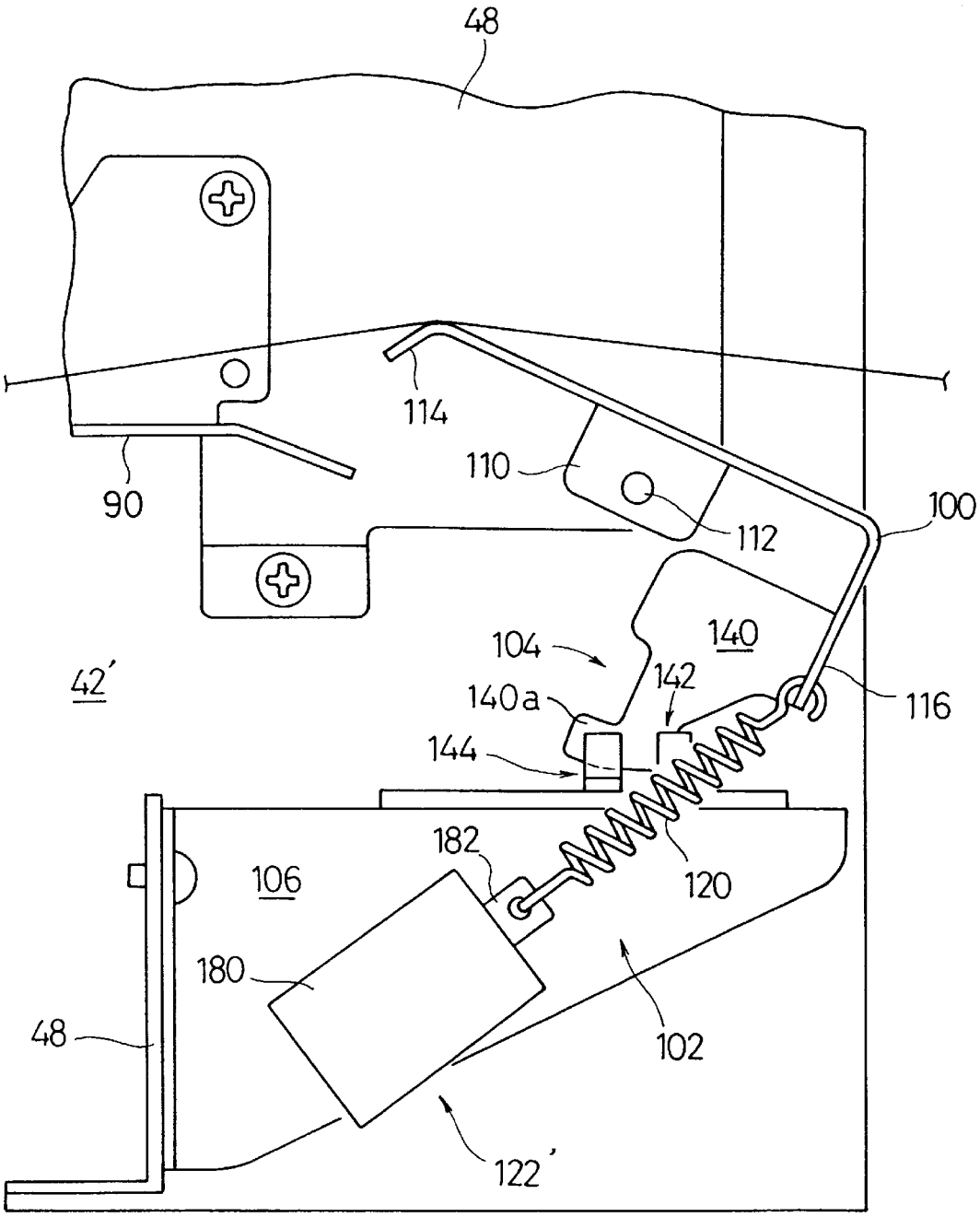
FIG. 6 is a side elevation showing another tension unit which may be used in place of the tension unit of FIGS. 1 to 4.

FIG. 6 is a side elevation showing another tension unit 42', which may be used in place of the tension unit 42 of FIGS. 3 and 4. Many of the elements of the tension unit 42 of FIGS. 3 and 4 are also used in the tension unit 42'. Therefore, like elements are designated by like reference numerals and are not described in detail for simplicity.

The differences between the tension units 42 and 42' only reside in the arrangement of the adjustment device for providing adjustment in the urging force to be applied by the urging mechanism 102 to the tensioning plate 100. Specifically, the adjustment device 122' in the tension unit 42' of FIG. 6 includes an electromagnetic actuator 180 fixedly mounted on a side wall of the support bed 106. The electromagnetic actuator 180 includes a solenoid and an output rod 182, which is axially movable and provides toggled motion between protruded and retracted positions upon energization of the solenoid. Thus, the electromagnetic actuator 180 is a 2-position actuator. The actuator 180 is disposed on the side wall of the support bed 106 such that the tip end of the output rod 182 is directed toward the second edge 116 of the tensioning plate 100. The spring 120, a helical tension spring, has a first end connected to the second edge 116 of the tensioning plate 100 and a second end connected to the output rod 182 of the actuator 180. Therefore, the electromagnetic actuator 180 constitutes a position setting mechanism for setting position of the second end of the spring 120.

The actuator 180 may be energized through a suitable driver under control of the control unit 150 of FIG. 5. The driver is not shown in FIG. 6 but corresponds to the driver 162 shown in FIG. 5. Further, the electromagnetic actuator 180 corresponds to the actuating mechanism 164 shown in FIG. 5. When the output rod 182 is located at the retracted position as shown in FIG. 6, a greater urging force (pulling force) is applied by the spring 120 to the tensioning plate 100. When it is located at the protruded position, a smaller urging force is applied. Thus, with this arrangement, the tension to be imposed to the target portion of the paper strip 12 may be selected from the two predetermined levels corresponding the greater and smaller urging forces applied to the tensioning plate 100. Thus, the above arrangement provides for two-level tension adjustment.

The use of the electromagnetic actuator 180 in the adjustment device 122' may make it difficult to provide three-level (or more level) adjustment as well as continuous adjustment, which may be readily provided by the adjustment device 122 using the cam member 130, as described with reference to FIGS. 3 and 4. However, the arrangement of the adjustment device 122' found in the tension unit 42' of FIG. 6 is much more simple in structure and less costly than the adjustment device 122 found in the tension unit 42 of FIGS. 3 and 4.

Figure 7:
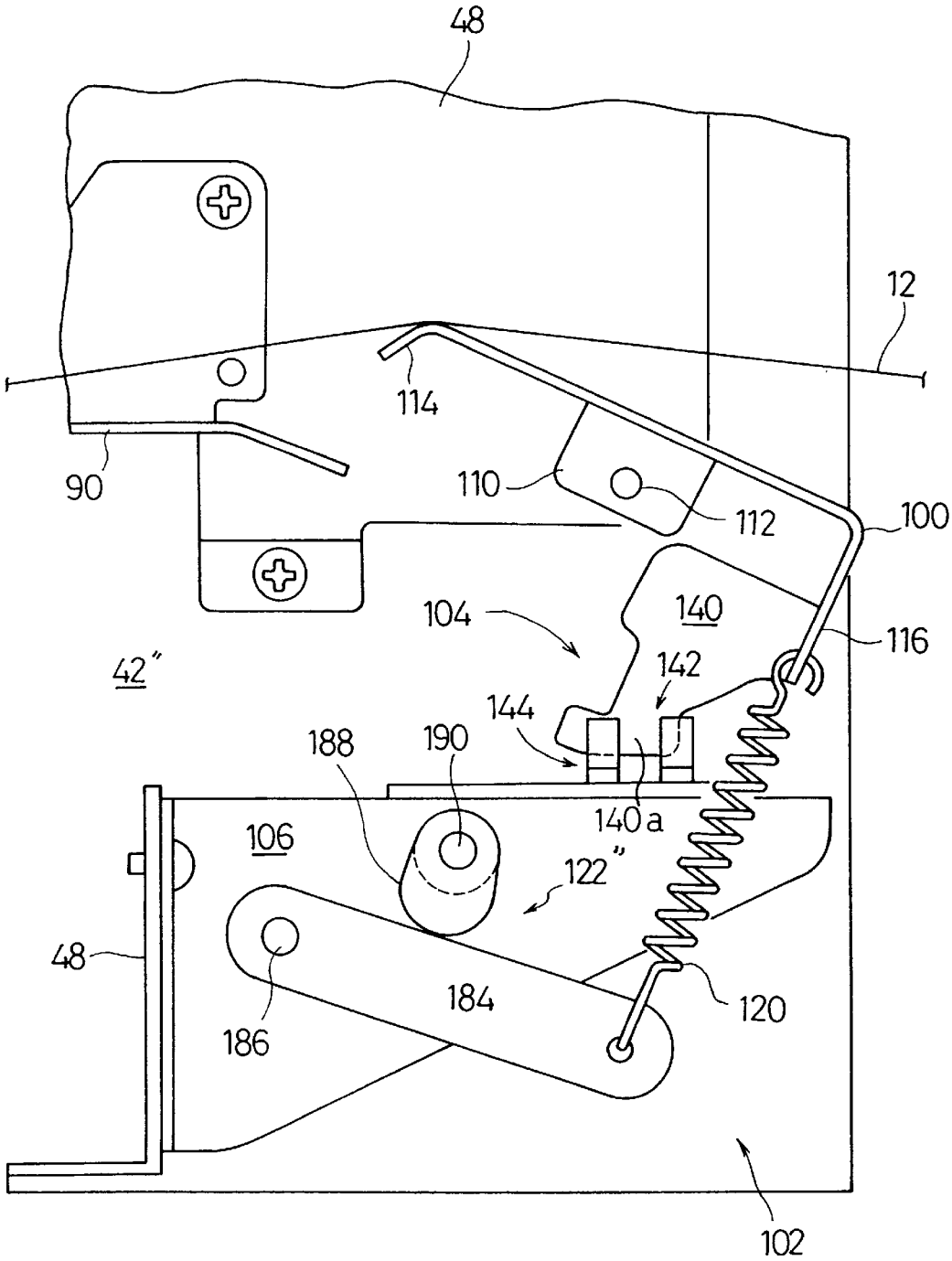
FIG. 7 is a side elevation showing a third tension unit which may be used in place of the tension unit of FIGS. 1 to 4.
Figure 8:
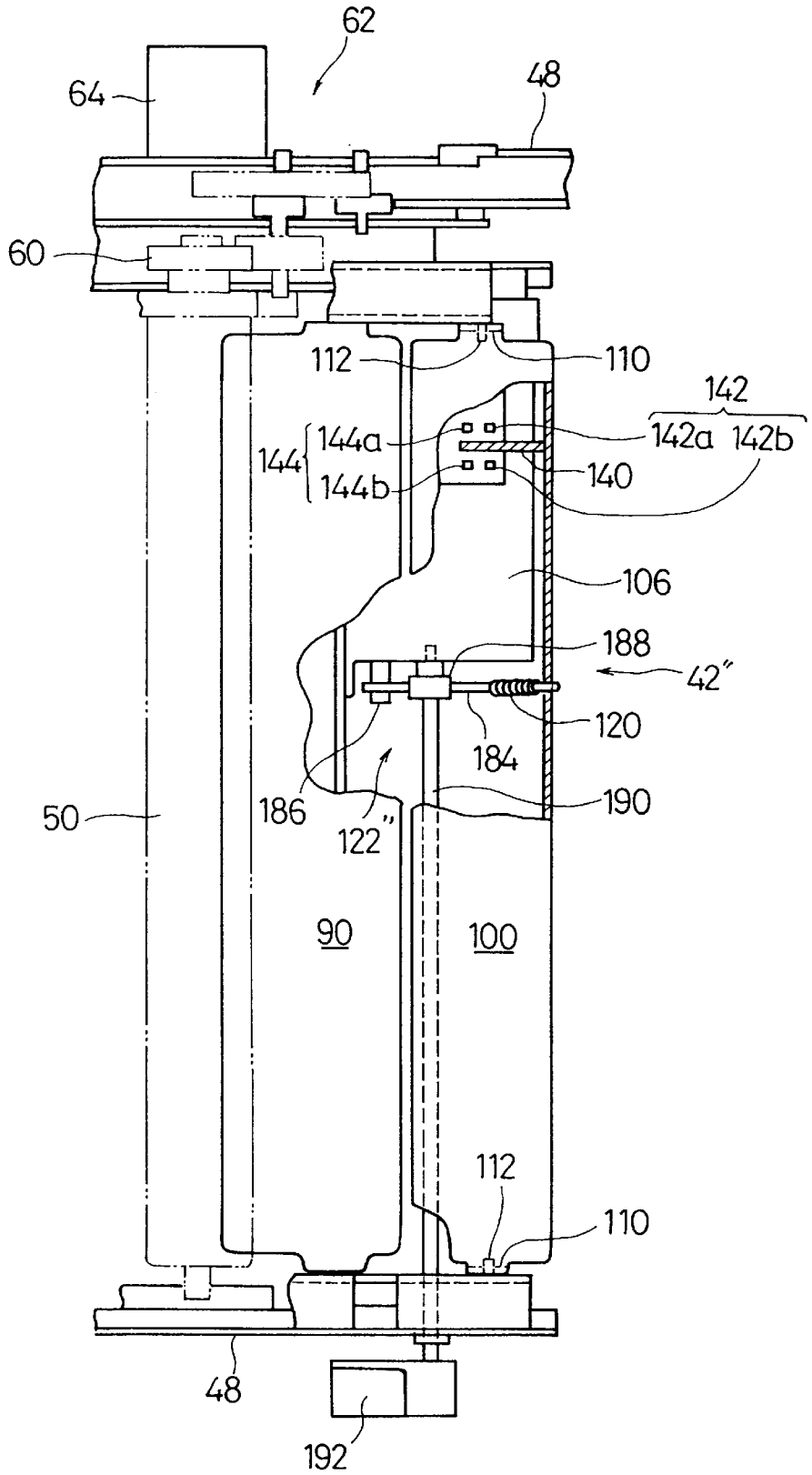
FIG. 8 is a plan view of the tension unit of FIG. 7.

FIGS. 7 is a side elevation and FIG. 8 is a plan view of a third tension unit 42", which may be used in place of the tension unit 42 of FIGS. 3 and 4. Again, many of the elements of the tension unit 42 of FIGS. 3 and 4 are also used in the tension unit 42". Therefore, like elements are designated by like reference numerals and are not described in detail for simplicity.

The differences between the tension units 42 and 42" only reside in the arrangement of the adjustment device for providing adjustment in the urging force to be applied by the urging mechanism 102 to the tensioning plate 100. Unlike the adjustment device 122 of FIGS. 3 and 4, the adjustment device 122" of FIGS. 7 and 8 is not motor-driven but manually-driven device. Specifically, the adjustment device 122" used in the tension unit 42" of FIGS. 7 and 8 comprises a swing arm 184, which has a first end pivotally connected to the side wall of the support bed 106 through a pivot pin 186. Therefore, the swing arm 186 has the first end supported for pivotal motion of the swing arm 186. There is provided an actuating mechanism for actuating the swing arm 186 to provide change in its angular position. The actuating mechanism comprises a cam member 188 fixedly mounted on a cam shaft 190, which extends parallel to the tensioning plate 100. The cam shaft 190 has a first end fitted in a hole formed in the side wall of the support bed 106. The cam shaft 190 has a second end fitted in and extending through a hole formed in the frame 48. The fittings in the holes allow rotation of the cam shaft 190. Further, the cam shaft 190 has a manually-driven handle lever 192 mounted on its second end protruded out of the frame 48. The spring 120, a helical tension spring, has a first end connected to the second edge 116 of the tensioning plate 100 and a second end connected to the second end of the swing arm 186. The swing arm 186 is normally pulled by the spring 120 toward the cam member 188, so that one longitudinal edge of the swing arm 186 is always kept pressed against the peripheral edge of the cam member 188, as shown in FIG. 7.

With this arrangement, when the operator rotates the handle lever 192 with his/her hand, the cam member 188 causes the second end of the swing arm 124 to move toward/away the second edge 116 of the tensioning plate 100. Therefore, the swing arm 186 and the actuating mechanism (comprising the cam member 188 and the handle lever 192) for actuating the swing arm 186 together constitute a position setting mechanism for setting position of the second end of the spring 120.

The operation and function of the tension unit 42" of FIGS. 7 and 8 are essentially the same as those of the tension unit 42 of FIGS. 3 and 4. The tension unit 42" of FIGS. 7 and 8 may be possibly fabricated to be more simple in structure and less costly than the tension unit 42 of FIG. 3 and 4.

Having described the present invention with reference to the preferred embodiment thereof, it is to be understood that the present invention is not limited to the disclosed embodiment, but may be embodied in various other forms without departing from the spirit and the scope of the present invention as defined by the appended claims.

What is claimed is:

1. An electrostatic image generating apparatus using a continuous strip of paper, comprising:

a photosensitized drum for generating thereon a toner image to be transferred to a the surface of said paper strip, said drum being associated with a paper feed mechanism operable in synchronism with speed of said drum so as to determine travel speed of said paper strip passing by said drum;

a fixing unit for fixing a toner image onto the toner image bearing surface of said paper strip, said fixing unit comprising a pair of fixing rollers for exerting a pressure to said paper strip passing therebetween and a roller drive mechanism for driving said fixing rollers so as to determine travel speed of said paper strip passing through said fixing unit;

a tension unit disposed between said drum said fixing unit for applying a tension to and thereby taking up slack of a portion of said paper strip that runs between said drum and said fixing unit;

said tension unit comprising (i) a tensioning element supported for displacement toward and away from the surface of said portion of said paper strip which is opposite to the toner bearing surface, (ii) an urging mechanism for urging said tensioning element to press it against said portion of said paper strip so as to apply a tension thereto and (iii) a sensing mechanism for sensing displacement of said tensioning element as an indication of tension being imposed to said portion of said paper strip;

a control unit connected to said sensing mechanism and said roller drive mechanism for controlling speed of said fixing rollers to maintain displacement of said tensioning element substantially at a predetermined desired level; and said tension unit further comprising an adjustment device for adjustment of an urging force to be applied by said urging mechanism to said tensioning element.

2. An electrostatic image generating apparatus according to claim 1, wherein:

said tensioning element is supported for pivotal motion about a pivot axis.

3. An electrostatic image generating apparatus according to claim 2, wherein:

said pivot axis extends in transverse direction of said paper strip.

4. An electrostatic image generating apparatus according to claim 3, wherein:

said tensioning element is elongated in shape and extends parallel to said pivot axis.

5. An electrostatic image generating apparatus according to claim 1, wherein:

said adjustment device provides for selection of level of urging force which is to be applied by said urging mechanism to said tensioning element, such that said level is selectable from two different predetermined levels.

6. An electrostatic image generating apparatus according to claim 1, wherein:

said adjustment device provides for selection of level of urging force which is to be applied by said urging mechanism to said tensioning element, such that said level is selectable from among three or more different predetermined levels.

7. An electrostatic image generating apparatus according to claim 1, wherein:

said adjustment device provides for selection of level of urging force which is to be applied by said urging mechanism to said tensioning element, such that said level is selectable to any desired level within a predetermined range.

8. An electrostatic image generating apparatus according to claim 2, wherein:

said urging mechanism comprises a torque generating mechanism for applying a torque to said tensioning element; and said adjustment device provides for adjustment in torque to be applied by said torque generating mechanism to said tensioning element.

9. An electrostatic image generating apparatus according to claim 8, wherein:

said torque generating mechanism comprises a spring member having first and second ends connected to said tensioning element and said adjustment device, respectively; and said adjustment device comprises a position setting mechanism for setting position of said second end of said spring member.

10. An electrostatic image generating apparatus according to claim 9, wherein:

said position setting mechanism comprises (i) a swing arm having a first end supported for pivotal motion and a second end connected to said second end of said spring member and (ii) an actuating mechanism for actuating said swing arm to provide change in angular position of said swing arm.

11. An electrostatic image generating apparatus according to claim 10, wherein:

said actuating mechanism comprises (i) a cam member acting on said swing arm and (ii) an electric motor having an output shaft operatively connected to said cam member.

12. An electrostatic image generating apparatus according to claim 10, wherein:

said actuating mechanism comprises (i) a cam member acting on said swing arm and (ii) a manually-driven handle operatively connected to said cam member.

13. An electrostatic image generating apparatus according to claim 9, wherein:

said position setting mechanism comprises an electromagnetic actuator having an output rod connected to said second end of said spring member.

14. An electrostatic image generating apparatus according to claim 1, wherein:

said paper feed mechanism comprises a tractor assembly engaging and advancing a strip of fan fold paper having regularly spaced perforations along its longitudinal marginal edges.

15. An electrostatic image generating apparatus according to claim 14, wherein:

said fan fold paper has transverse cutting lines of fine perforations provided at predetermined longitudinal intervals to establish substantially equal sized individual panels; and said fan folder paper is alternately folded along said cutting lines with one panel upon another.

16. An electrostatic image generating apparatus according to claim 1, wherein:

said apparatus is adapted to use a continuous strip selected from the group consisting of a strip of bond paper, a strip of cardboard, a strip of label carrier and a strip of transparency substrate.

* * * * *